US006077653A

United States Patent [19]

McGarry et al.

[11] Patent Number: 6,077,653

[45] Date of Patent: Jun. 20, 2000

[54] PHOTOGRAPHIC DEVELOPING COMPOSITIONS AND METHODS OF USING 1,4-CYCLOHEXANEDIONES AS ANTIOXIDANTS

[75] Inventors: Lynda W. McGarry, North Chili; Tiecheng A. Qiao, Webster, both of N.Y.

[73] Assignee: Eastman Kodak Company, Rochester, N.Y.

[21] Appl. No.: 09/123,976

[22] Filed: Jul. 29, 1998

[51] Int. Cl.[7] ..... G03C 7/413

[52] U.S. Cl. ..... 430/490; 430/434; 430/465; 430/466; 430/486; 430/497

[58] Field of Search ..... 430/486, 490, 430/465, 466

[56] References Cited

U.S. PATENT DOCUMENTS

| | | | |
|---|---|---|---|
| 2,131,742 | 10/1938 | Kumetat et al. | 430/486 |
| 2,132,169 | 10/1938 | Kumetat et al. | 430/486 |
| 2,265,138 | 12/1941 | Birr | 430/486 |
| 4,772,432 | 9/1988 | Miyashita | 552/303 |
| 4,816,384 | 3/1989 | Fruge et al. | 430/465 |
| 4,923,786 | 5/1990 | Kuhnert et al. | 430/465 |
| 4,987,060 | 1/1991 | Marchesano | 430/465 |
| 5,273,864 | 12/1993 | Ishikawa et al. | 430/387 |
| 5,354,646 | 10/1994 | Kobayashi et al. | 430/372 |
| 5,512,243 | 4/1996 | Roling | 422/14 |
| 5,660,974 | 8/1997 | Marrese et al. | 430/490 |

*Primary Examiner*—Hoa Van Le
*Attorney, Agent, or Firm*—J. Lanny Tucker

[57] ABSTRACT

Certain 1,4-cyclohexanediones are useful as antioxidants in photographic developing compositions. These compounds stabilize the compositions, are water soluble and are essentially odorless. These antioxidants can be used in either black and white or color developing compositions used to process photographic silver halide materials.

19 Claims, 2 Drawing Sheets

PHOTOGRAPHIC DEVELOPING COMPOSITIONS AND METHODS OF USING 1,4-CYCLOHEXANEDIONES AS ANTIOXIDANTS

FIELD OF THE INVENTION

The present invention relates to photographic developing compositions and to their use in the processing of silver halide photographic materials. More specifically, it relates to photographic developing compositions having certain 1,4-cyclohexanediones. These compositions and methods are useful in the field of photography.

BACKGROUND OF THE INVENTION

Photographic color developing compositions are used to process color photographic materials such as color photographic films and papers to provide the desired color images. Such compositions generally contain color developing agents, for example 4-amino-3-methyl-N-(β-methane sulfonamidoethyl)aniline, as reducing agents to react with suitable color forming couplers to form the desired dyes. However, such color developing agents are susceptible to oxidation by dissolved oxygen. Therefore, an antioxidant is conventionally included in the color developer compositions to preserve the oxidation state of the color developing agent and thereby maintain useful color developer activity.

Many classes of compounds have been employed as color developer solution antioxidants, including hydroxylamines, hydroxamic acids, oximes, nitroxy radicals, hydrazines, hydrazides, phenols, saccharides, various simple amines, polyamines, quaternary ammonium salts, alpha-hydroxy ketones, alcohols, diamides and disulfonamides. To be used in practice, however, antioxidants must be soluble in aqueous media, non-toxic to living organisms, low cost and non-silver halide developers. Further, it is desirable that antioxidants react slowly with oxygen and rapidly with oxidized color developer, but not so rapidly that color development is retarded. Yet another concern is that the antioxidant must not be able to promote bacterial growth.

All of these considerations greatly limit the number and classes of compounds that practically can be used as antioxidants or stabilizers in color developer solutions. One class of compounds often used as antioxidants are hydroxylamines. They exhibit excellent characteristics by having a slow rate of aerial oxidation, being non-silver halide developers, and relatively inexpensive to produce. There are considerable publications describing such compounds.

While there is considerable literature describing various hydroxylamines that can be used as antioxidants, most of them have a number of disadvantages. For example, making them with certain solubilizing groups may be difficult or expensive. In addition, even when generally water-soluble, they may still emit an unpleasant odor that is offensive to users in the photoprocessing industry. Given the growth of photoprocessing in mini-lab processors in highly populated places such as supermarkets and malls, it is highly desirable that the color developers be as odor free as possible.

U.S. Pat. No. 4,892,804 (Vincent et al) describes a number of dialkylhydroxylamines useful as color developer antioxidants, including N,N-diethylhydroxylamine, which are improvements over the unsubstituted or monosubstituted hydroxylamines. U.S. Pat. No. 4,876,174 (Ishikawa et al) describes a lengthy list of substituted hydroxylamines believed useful as antioxidants in color developer compositions, but the compounds actually used emit unpleasant odors.

In U.S. Pat. No. 5,354,646 (Kobayashi et al), water-solubilizing groups, such as carboxy and sulfo are shown on dialkylhydroxylamines. Certain cyclic hydroxylamines are described in U.S. Pat. No. 5,660,974 (Marrese et al).

As the antioxidants shown in the art have varying and unpredictable effects, there remains a need to find relatively inexpensive, odorless and consistently effective antioxidants for color developer compositions.

SUMMARY OF THE INVENTION

This invention provides a photographic developing composition comprising:

a) a photographic developing agent, and b) a 1,4-cyclohexanedione antioxidant present in an amount of at least 0.001 mol/l, the antioxidant being represented by the Structure I:

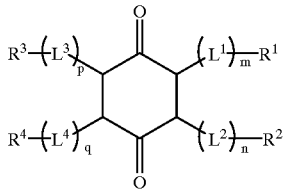

wherein m, n, p and q are independently 0 or 1, $L_1$, $L_2$, $L_3$ and $L_4$ are independently a divalent linking group, and $R_1$, $R_2$, $R_3$ and $R_4$ are independently hydrogen, an alkyl group, an aryl group, sulfo, carboxy, phospho, phosphono, phosphino, amino, cyano, hydroxy, a cycloalkyl group or a heterocyclic group.

This invention also provides a method for forming an image comprising contacting an imagewise exposed photographic silver halide element with the photographic developing composition described above.

Further, this invention provides a method of photographic processing comprising the steps of:

A) developing an imagewise exposed photographic silver halide element with the photographic developing composition described above, and B) desilvering the developed photographic silver halide element.

In addition, a photographic processing chemical kit of this invention includes:

a) the photographic developing composition described above, and b) one or more of the following photographic processing compositions:

a photographic bleaching composition, a photographic bleach/fixing composition, a photographic fixing composition, and a photographic stabilizing or rinsing composition.

The photographic developing composition of this invention provides a number of significant advantages including less or no odor and desired imaging performance without undesirable sensitometric performance. These advantages are provided by the use of certain 1,4-cyclodexanediones as the antioxidants.

DETAILED DESCRIPTION OF THE INVENTION

Figure 1:
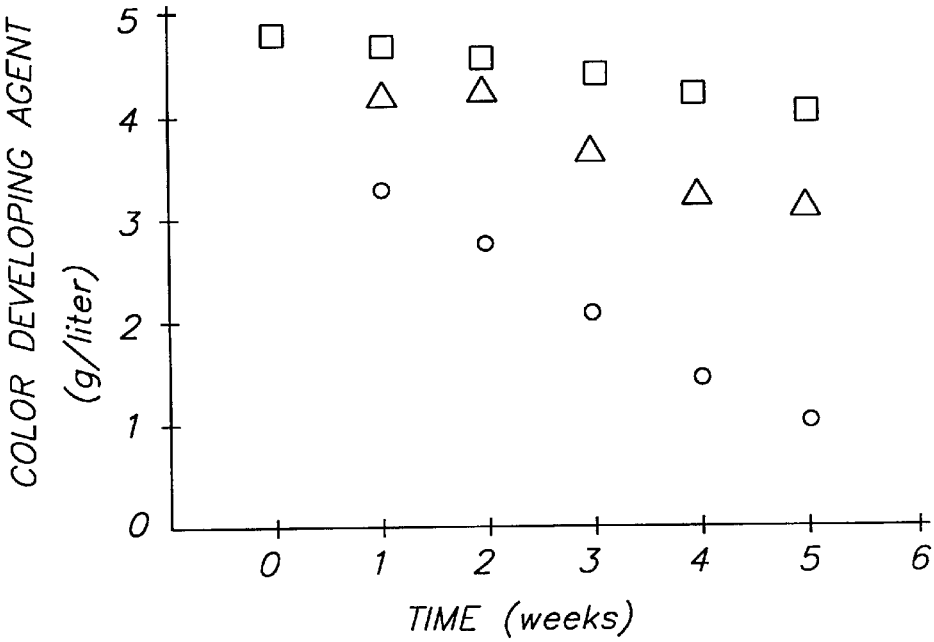
FIG. 1 is a graphical plot of color developing agent concentration over time for the standing test experimentation described in Example 1 below.

The 1,4-cyclohexanediones that are useful as antioxidants in the practice of this invention can be more particularly defined using Structure I:

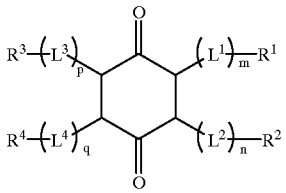

In this structure, $L_1$, $L_2$, $L_3$ and $L_4$ are independently divalent linking groups comprising one or more carbon, oxygen, sulfur or nitrogen atoms in the chain, in any suitable combination. Useful divalent groups include, but are not limited to, substituted or unsubstituted alkylene groups having 1 to 10 carbon atoms (branched or linear), substituted or unsubstituted cycloalkylene groups having 6 to 10 carbon atoms in the cyclic ring, substituted or unsubstituted arylene groups having 6 to 10 carbon atoms in the cyclic ring, oxy, thio, imino, carbonyl and sulfonyl. As noted above, two or more of such linking groups can be connected in the chain (for example, to form carbonyloxy, sulfonimino, alkylenearylene, oxyalkylene, polyoxyalkylene, alkyleneoxy, and others readily apparent to one skilled in the art). Preferably, $L_1$, $L_2$, $L_3$ and $L_4$ are independently alkylene groups having 1 to 3 carbon atoms, phenylene, oxy or oxyalkylene (having 1 to 3 carbon atoms). More preferably, $L_1$, $L_2$, $L_3$ and $L_4$ are independently methylene, oxy, phenylene or oxymethylene.

In addition, m, n, p and q are independently 0 or 1. Preferably, at least one of m, n, p and q is 1, more preferably at least m and q are each 1, and most preferably, only m is 1.

$R_1$, $R_2$, $R_3$ and $R_4$ are independently hydrogen, a substituted or unsubstituted alkyl group having 1 to 10 carbon atoms (such as methyl, ethyl, n-propyl, isopropyl, t-butyl, n-hexyl, 2-methylhexyl, decyl, benzyl, methoxymethyl, 2-hydroxethyl and others readily apparent to one skilled in the art), a substituted or unsubstituted aryl group having 6 to 10 carbon atoms (such as phenyl, naphthyl, anthryl, tolyl, xylyl, 3-methoxyphenyl, 4-chlorophenyl, 4-carbomethoxyphenyl, 4-cyanophenyl and others readily apparent to one skilled in the art), a substituted or unsubstituted cycloalkyl group having 5 to 14 carbon atoms (such as cyclopentyl, cyclohexyl, cyclooctyl, 4-methoxycyclohexyl, 3-chlorocyclohexyl and others readily apparent to one skilled in the art), a substituted or unsubstituted heterocyclic group having 5 to 10 carbon and heteroatoms (such as pydridinyl, pyridyl, primidyl, morpholino, furanyl and others readily apparent to one skilled in the art), cyano, carboxy, sulfo, phosphono, phospho, phosphino, hydroxamic acid, hydroxy, or corresponding salts where appropriate. Many of these groups can be substituted with one or more sulfonate, sulfate, carboxy, hydroxy, phosphono, hydroxamic acid, amine, amide, ester, a sulfoamide, nitro, cyano, oxo or halo groups.

Preferably, at least one of $R_1$, $R_2$, $R_3$ and $R_4$ is or contains a solubilizing group that becomes negatively charged when ionized, including but not limited to, carboxy, sulfo, or phosphono (and corresponding salts where appropriate). Thus, the preferred 1,4-cyclohexanediones useful in this invention comprise one or more of such solubilizing groups.

If each of m, n, p and q is 0, $R_1$ and $R_2$ together, or $R_3$ and $R_4$ together, can be joined with sufficient numbers of carbon, oxygen, sulfur or nitrogen atoms to form a 5- or 6-membered unsaturated ring structure that is fused with the 1,4-cyclohexandione central ring.

Representative compounds of Structure I include the following Compounds I–XIII:

I

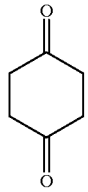

II

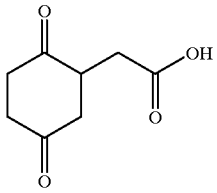

III

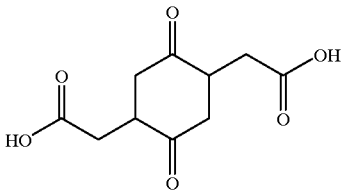

IV

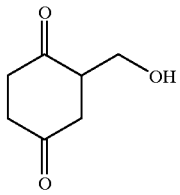

V

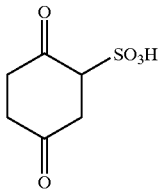

VI

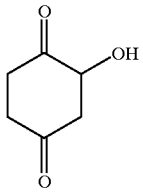

-continued

VII

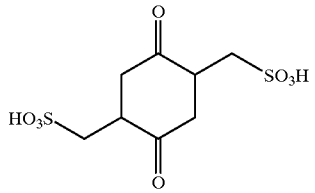

VIII

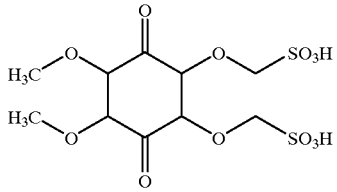

IX

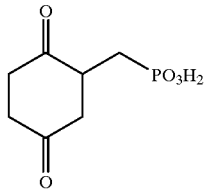

X

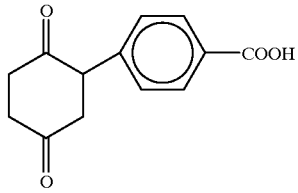

XI

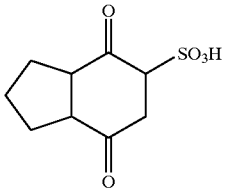

XII

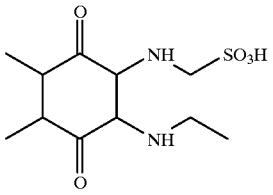

XIII

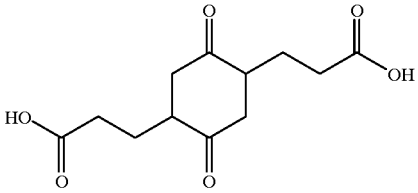

Preferred compounds are Compounds II and XIII. Compound I is commercially available from a number of commercial sources (such as Aldrich Chemical). The remaining listed compounds can be prepared using the synthetic procedures and routine modifications that would be readily apparent to one skilled in the art of synthetic organic chemistry. The following synthetic procedures are representative.

Synthesis of Compound II: (2,5-Dioxocyclohexyl)acetic acid

A solution of 3.6 g (20 mmol) of (2,5-dimethoxyphenyl) acetic acid, 30 g (0.4 mole) of anhydrous t-butanol, and 40 ml of anhydrous tetrahydrofuran (THF) was added to 200 ml of liquid ammonia at −78° C. via cannula. Lithium wire (1.5 g, 0.21 mol) was cut into small pieces, washed briefly with isopropylalcohol and hexane, and then added to the above mixture piece by piece. The resulting reaction mixture turned a dark blue-gray color. After 4 hours, the blue color faded to gray, some excess ammonium chloride (4 g) was added, and the ammonia was allowed to evaporate overnight under a stream of nitrogen, leaving a white solid. The residue was then treated with 80 ml of 6 N hydrochloric acid, and the resultant mixture was heated to reflux for 1.5 hours.

The solution was cooled and then extracted with ethyl acetate (5×150 ml); the organic layer was dried over anhydrous magnesium sulfate, and the solvent was evaporated to give a viscous yellow oil which solidified upon standing overnight. The crude material was purified by chromatography on silica gel using 60% dichloromethane, 39.5% ethyl acetate, and 0.5% acetic acid as the eluent. The purified oil was crystallized using ethyl acetate/hexane to give 1.8 g of the product as white crystals. Analysis yielded: $^1$H NMR (DMSO-d$^6$)-d 12.1 (s,1H), d 3.3 (br.s,1H), d 3.1 (m,1H), d 2.9–2.2 (m,7H). mp 93–95° C.; Mass spec. (FDMS) m/e= 170 for $C_8H_{10}O_4$. More details for this synthesis can be found in the publication by Baghdadchi et al, *J.Org.Chem.,* 48(21), 3852-4 (1983).

Synthesis of Compound XIII: Cyclohexane-2,5-dione-1,4-ylene(3-propionic acid):

A 500 ml 3-necked flask equipped with a reflux condenser, a magnetic stirrer, and a nitrogen inlet was charged with 175 ml of anhydrous methanol, diethyl succinylsuccinate (32.03 g, 0.125 moles), ethyl acrylate (27.1 ml, 0.25 moles), and sodium methoxide [2.3 ml of 25% (w/w)] in methanol (0.01 mol). The resulting mixture was heated to reflux under nitrogen and stirred for 36 hours. After cooling to room temperature, the reaction mixture was filtered to remove a small amount of unreacted starting material. Thin layer chromatographic analysis revealed that there was no remaining starting material, and the filtered reaction mixture was concentrated under reduced pressure to a brown oil. A mixture of water (20 ml) and benzene (30 ml) was added to the oil, and the mixture was poured into a separatory funnel. The benzene layer was collected, dried over sodium sulfate, and concentrated under reduced pressure to a brown oil. The brown oil was then dissolved in a minimum amount of methylene chloride and filtered through a pad of silica gel. It was eluted first with methylene chloride, and then with ethyl acetate. The methylene chloride eluents were concentrated to a yellow oil (36 g) that crystallized upon standing. 1H NMR and mass spectral data (m/e 456) confirmed the identity of the product, 1,4-bis(ethoxycarbonyl)-2,5-dioxo-1,4-cyclohexanedipropanoic acid, diethyl ester ($C_{22}H_{32}O_{10}$).

The oil noted above (36 g, 0.079 mol) was added to 60 ml of water and 2.0 g of concentrated sulfuric acid. The resulting mixture was heated to reflux for 4 days while distilling off the ethanol that was formed each day. After cooling to ambient temperature, pale yellow crystals formed and were collected by filtration. The solid was recrystallized from water to give 5.6 g of the desired cyclohexane-2,5-dione-1,4-ylene(3-propionic acid). $^1$H NMR(DMSO-d$^6$)-d 3.5(br,s), 2.7 (m), 2.5 (m), 2.1(t), 1.8 (m), 1.4 (m). Mass spec. m/e 256, and m.p. 190–192° C.

The antioxidant is included in the developing composition of this invention in an amount of at least about 0.001 mol/l, and a preferred amount is from about 0.005 to about 0.5 mol/l. A more preferred amount is from about 0.01 to about 0.1 mol/l. More than one antioxidant compound described herein can be used in the same developing composition if desired, but preferably, only one is used. In addition, the 1,4-cyclohexandiones described herein can be used in combination with other compounds known to be used as antioxidants, such as hydroxylamine (and derivatives thereof) and hydrazines.

When the developing composition is an aqueous solution, its pH is generally from about 9 to about 13 (preferably from about 9 to about 12), as provided by the addition of one or more weak or strong bases (such as a hydroxide) or buffers in amounts readily known in the art. Particularly useful buffers include, but are not limited to, carbonates, borates, tetraborates, phosphates, glycine salts, leucine salts, valine salts, proline salts, alanine salts, aminobutyric acid salts, lysine salts, guanine salts and hydroxybenzoates.

The developing compositions of this invention include one or more black and white or color developing agents, of which there are hundreds of possibilities. Preferably, the developing agent is a color developing agent. Such materials include, but are not limited to, aminophenols, p-phenylenediamines (especially N,N-dialkyl-p-phenylenediamines) and others which are well known in the art, such as EP 0 434 097A1 (published Jun. 26, 1991) and EP 0 530 921A1 (published Mar. 10, 1993). It may be useful for the color developing agents to have one or more water-solubilizing groups as are known in the art. Further details of such materials are provided in *Research Disclosure*, publication 38957, pages 592–639 (September 1996). *Research Disclosure* is a publication of Kenneth Mason Publications Ltd., Dudley House, 12 North Street, Emsworth, Hampshire PO10 7DQ England (also available from Emsworth Design Inc., 121 West 19th Street, New York, N.Y. 10011). This reference will be referred to hereinafter as "*Research Disclosure*".

Useful black and white developing agents include hydroquinone and derivatives thereof, and ascorbic acid and derivatives thereof, as described for example in U.S. Pat. No. 5,702,875 (Opitz et al), U.S. Pat. No. 5,738,979 (Fitterman et al) and other publications too numerous to mention.

The developing agent is generally present in the developing composition in an amount of at least 0.001 mol/l, and preferably in an amount of at least 0.005 mol/l. As much developing agent can be used that is desired for a given processing method, but generally it is present in an amount of 0.1 mol/l or less.

The developing compositions can be easily prepared by mixing a suitable developing agent with an antioxidant as described above, in a suitable aqueous solution, or dry powder mixtures. Water can be added to resulting solutions to provide the desired concentrations of an aqueous solution, and the pH can be adjusted as noted above.

The developing compositions can also include one or more of a variety of other addenda which are commonly used in such compositions, including alkali metal halides (such as potassium chloride, potassium bromide, sodium bromide and sodium iodide), metal sequestering agents (such as polycarboxylic or aminopolycarboxylic acids or polyphosphonates), buffers (as noted above), other preservatives (such as sulfites), auxiliary co-developing agents (such as phenidone type compounds particularly for black and white developing compositions), antifoggants, development accelerators, optical brighteners, wetting agents, stain reducing agents, surfactants, defoaming agents, and water-soluble or water-dispersible color couplers, as would be readily understood by one skilled in the art [see for example, *Research Disclosure*, noted above, U.S. Pat. No. 5,738,979 (noted above) and U.S. Pat. No. 4,814,260 of Koboshi et al]. The amounts of such additives are well known in the art also. A preferred color developing composition is described below in Example 1.

The photographic developing compositions are preferably formulated and used as an aqueous solution, either as the working strength solution or as a replenishing solution. However, as is known in the art, photographic developing compositions can also be formulated as used as dry tablets. The technology for this embodiment is readily known in the art, such as U.S. Pat. No. 5,362,610 (Yoshimoto), U.S. Pat. No. 5,376,509 (Yoshimoto et al) and EP-A-0 611 986A1 (published Aug. 24, 1994).

Black and white developing compositions of this invention can be used to process any suitable black and white photographic silver halide element, including graphics, aerial photography and amateur and professional black and white photographic negative and reversal films and papers. In addition, they can be used as the developing composition in the "first development" step used to process color reversal photographic films.

The color developing compositions of this invention have utility to provide color development in an imagewise exposed color photographic silver halide element comprising a support and one or more silver halide emulsion layers containing an imagewise distribution of developable silver halide emulsion grains. A wide variety of types of photographic elements (both color films and papers, and color motion picture films and prints) containing various types of emulsions can be processed using the present invention, the types of elements being well known in the art (see *Research Disclosure*, noted above). In particular, the invention can be used to process color photographic papers of all types of emulsions, including so-called "high chloride" and "low chloride" type emulsions, and so-called tabular grain emulsions as well. The color developer solution can also be used in color reversal processing of color reversal films and papers.

The present invention is particularly useful to process high chloride (greater than 70 mole % chloride and preferably greater than 90 mole % chloride, based on total silver) emulsions in color photographic papers. Such color photographic papers can have any useful amount of silver coated in the one or more emulsions layers, and in some embodiments, low silver (that is, less than about 0.8 g silver/$m^2$) elements are processed with the present invention. The layers of the photographic elements can have any useful binder material or vehicle as it known in the art, including various gelatins and other colloidal materials.

Development of an imagewise exposed photographic silver halide element is carried out by contacting the element with the developing composition of this invention under suitable time and temperature conditions, in suitable processing equipment, to produce the desired developed image. Additional processing steps can then be carried out using conventional procedures, including but not limited to, one or more development stop, bleaching, fixing, bleach/fixing, washing (or rinsing), stabilizing and drying steps, in any particular desired order as would be known in the art. Useful processing steps, conditions and materials useful therefor are well known for the various processing protocols including the conventional Process C-41 processing of color negative films, Process RA-4 for processing color papers and Process E-6 for processing color reversal films (see for example, *Research Disclosure*).

The photographic elements processed in the practice of this invention can be single or multilayer color elements. Multilayer color elements typically contain dye image-forming units sensitive to each of the three primary regions of the visible spectrum. Each unit can be comprised of a single emulsion layer or multiple emulsion layers sensitive to a given region of the spectrum. The layers of the element can be arranged in any of the various orders known in the art. In an alternative format, the emulsions sensitive to each of the three primary regions of the spectrum can be disposed as a single segmented layer. The elements can also contain other conventional layers such as filter layers, interlayers, subbing layers, overcoats and other layers readily apparent to one skilled in the art. A magnetic backing can be included on the backside of conventional supports.

Considerably more details of the element structure and components, and suitable methods of processing various types of elements are described in *Research Disclosure*, noted above. Included within such teachings in the art is the use of various classes of cyan, yellow and magenta color couplers that can be used with the present invention (including pyrazolone and pyrazolotriazole magenta dye forming couplers). In addition, the present invention can be used to process color photographic papers having pigmented resin-coated paper supports which are prepared with the usual internal and external sizing agents (including alkylketene dimers and higher fatty acids), strengthening agents and other known paper additives and coatings.

The elements are typically exposed to suitable radiation to form a latent image and then processed to form a visible dye and/or silver image. In color photographic processing, processing includes the step of color development in the presence of a color developing agent to reduce developable silver halide and to oxidize the color developing agent. Oxidized color developing agent in turn reacts with a color-forming coupler to yield a dye.

The developing composition of this invention can also be used in what are known as redox amplification processes, as described for example, in U.S. Pat. No. 5,723,268 (Fyson) and U.S. Pat. No. 5,702,873 (Twist).

Processing according to the present invention can be carried out using conventional deep tanks holding processing solutions. Alternatively, it can be carried out using what is known in the art as "low volume thin tank" processing systems, or LVTT, which have either a rack and tank or automatic tray design.

Such processing methods and equipment are described, for example, in U.S. Pat. No. 5,436,118 (Carli et al) and publications noted therein.

For color processing, color development is generally followed by a bleaching or bleach/fixing step using a suitable silver bleaching agent. Numerous bleaching agents are known in the art, including hydrogen peroxide and other peracid compounds, persulfates, periodates and ferric ion salts or complexes with polycarboxylic acid chelating ligands. Particularly useful chelating ligands include conventional polyaminopolycarboxylic acids including ethylenediaminetetraacetic acid and others described in *Research Disclosure*, noted above, U.S. Pat. No. 5,582,958 (Buchanan et al) and U.S. Pat. No. 5,753,423 (Buongiorne et al). Biodegradable chelating ligands are also desirable because the impact on the environment is reduced. Useful biodegradable chelating ligands include, but are not limited to, iminodiacetic acid or an alkyliminodiacetic acid (such as methyliminodiacetic acid), ethylenediaminedisuccinic acid and similar compounds as described in EP-A-0 532,003, and ethylenediamine monosuccinic acid and similar compounds as described in U.S. Pat. No. 5,691,120 (Wilson et al).

The processing time and temperature used for each processing step of the present invention are generally those conventionally used in the art. For example, development is generally carried out at a temperature of from about 20 to about 60° C. The overall development time can be up to 10 minutes, and preferably less than 450 seconds. Overall development times of at least 60 seconds are generally used for processing color photographic papers.

The developing composition of this invention can be formulated as a concentrated single-part, ready-to-use aqueous developing composition that can be diluted appropriately during or prior to use. In addition, it can be used as a processing tank or replenisher solution, or both.

In one embodiment of this invention, the developing composition is one chemical formulation (dry or liquid) in a photographic processing chemical kit that can include one or more other photographic processing compositions (dry or liquid) including, but not limited to, a photographic bleaching composition, a photographic bleach/fixing composition, a photographic fixing composition, and a photographic stabilizing or rinsing composition. Such additional compositions can be formulated in concentrated or working strength solutions, or provided in dry form (for example, powder or tablet). Other processing compositions that can be included in such kits for either black and white or color photographic processing are reversal compositions, conditioning compositions, prebleach compositions, acidic stop compositions, and others readily apparent to one skilled in the photographic art. The processing kits can also include various processing equipment, metering devices, processing instructions, silver recovery devices and other articles that would be readily apparent to one skilled in the art.

The following examples are provided to illustrate the practice of this invention and not to limit it in any way. Unless otherwise indicated, percentages are by weight.

EXAMPLE 1

Color paper developing compositions were made using the compounds listed in TABLE I with different antioxidants as listed in TABLE II.

TABLE I

| | |
|---|---|
| Triethanolamine | 11 ml |
| Lithium polystyrene sulfonate (30% w/w solution) | 0.25 ml |
| Potassium sulfite (45%) | 0.5 ml |
| KODAK EKTAPRINT 2 Stain Reducing Agent | 2.30 g |
| Lithium sulfate | 2.70 g |
| 1-Hydroxyethylidene-1,1-diphosphonic acid (60% w/w solution) | 0.80 ml |
| Potassium chloride | 6.40 g |
| Potassium bromide | 0.028 g |
| 4-amino-3-methyl-N-ethyl-N-(b-methanesulfonamidoethyl)aniline sesquisulfate monohydrate (CD3) | 4.85 g |
| Potassium carbonate | 25 g |
| Antioxidant | from TABLE II |
| Water to make (pH adjusted to 10.1 with KOH) | 1 liter |

TABLE II

| None (Blank) | Comparative Example |
|---|---|
| N,N-Diethylhydroxylamine | 5.5 ml (Conventional Process RA-4) |
| 1,4-Cyclohexanedione (Compound I) | 5.6 g (Invention) |
| (2,5-Dioxocyclohexyl)acetic acid (Compound II) | 8.5 g (Invention) |

Figure 2:
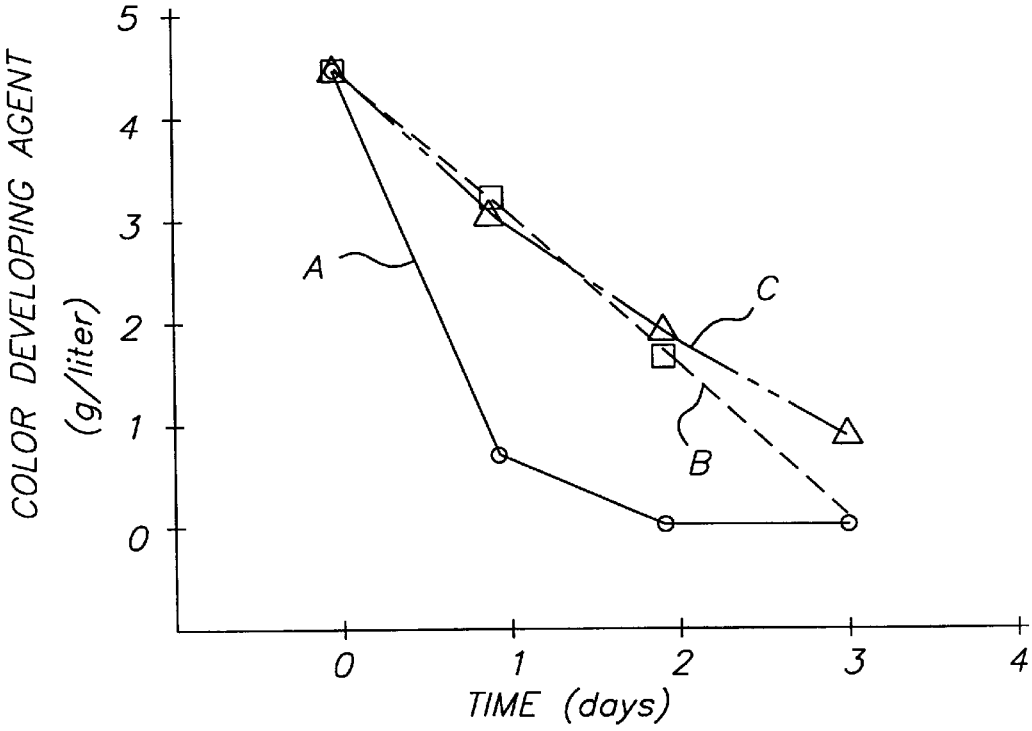
FIG. 2 is a graphical plot of color developing agent concentration over time for the aeration experimentation described in Example 1 below.
Figure 3:
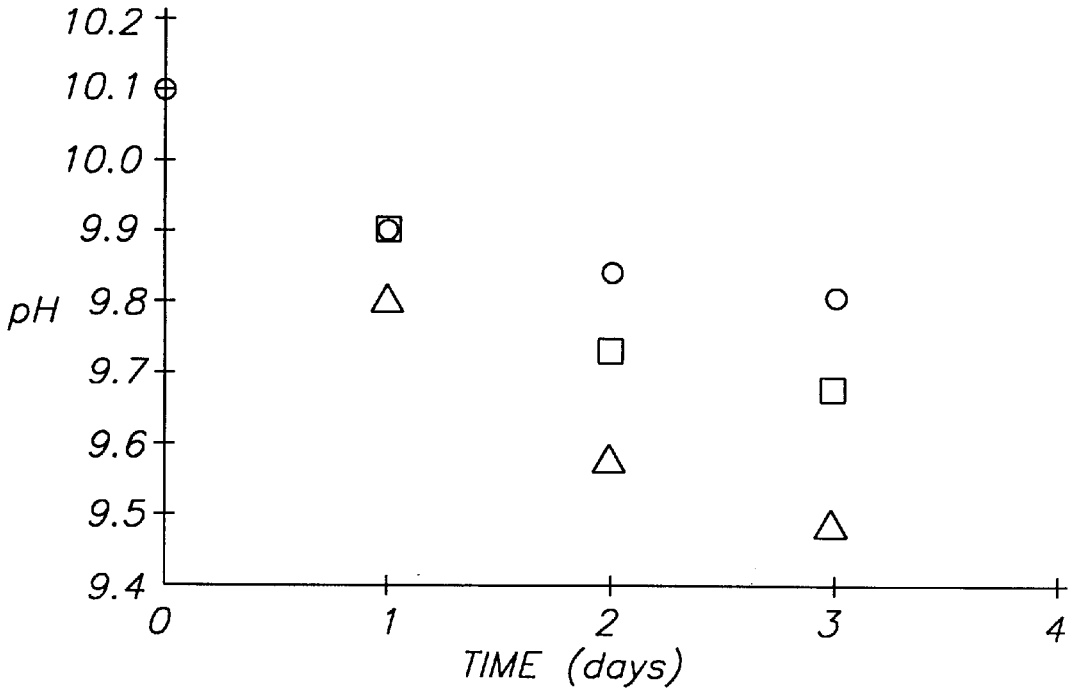
FIG. 3 is a graphical plot of pH over time for the experimentation described in Example 1 below.

Standing tests, in which each developing composition was exposed to air without agitation, were performed on 100 ml scale at 35° C. and the results are shown in FIG. 1 ("Blank" identified by circles, Compound I by triangles, and Compound II by squares). The developing compositions were also subject to an accelerated aeration test, in which air was bubbled into the solution with controlled flow rate, to obtain the relationship of color developing agent (CD-3) concentration versus aerial oxidation time. The results are shown in FIG. 2 (Curve A for "Blank", Curve B for Compound I, and Curve C for Compound II). The developing composition pH was also measured as a function of aeration time and the results are shown in FIG. 3 ("Blank" identified by circles, Compound I by triangles, and Compound II by diamonds). The standing test indicates that both 1,4-cyclohexanedione and (2,5-dioxocyclohexyl)acetic acid protected CD-3 from being oxidized. In the accelerated aeration test, N,N-diethylhydroxylamine and (2,5-dioxocyclohexyl) acetic acid show almost identical preserving power followed by 1,4-cyclohexanedione with a slightly weaker antioxidation effect.

EXAMPLE 2

The developing compositions described in Example 1 were examined for their photographic effect by processing samples of conventional KODAK EDGE 5 Color Paper using standard RA-4 processing method and solutions. The results are shown in TABLES III, IV and V, for N,N-diethylhydroxylamine, 1,4-cyclohexanedione (Compound I), and (2,5-dioxocyclohexyl)acetic acid (Compound II), respectively, as the antioxidants. N,N-Diethylhydroxylamine is an antioxidant commonly used in commercial Process RA-4.

TABLE III

| | Blank Control (No Antioxidant) | N,N-diethylhydroxylamine (Comparative example) | Difference (Comparison) |
|---|---|---|---|
| Red Dmin | 0.102 | 0.104 | 0.002 |
| Green Dmin | 0.087 | 0.085 | −0.002 |
| Blue Dmin | 0.093 | 0.093 | 0 |
| Red Toe | 0.368 | 0.374 | 0.006 |
| Green Toe | 0.380 | 0.393 | 0.013 |
| Blue Toe | 0.348 | 0.358 | 0.01 |
| Red Shoulder | 2.145 | 2.067 | −0.078 |
| Green Shoulder | 1.854 | 1.705 | −0.149 |
| Blue Shoulder | 1.886 | 1.752 | −0.134 |
| Red Dmax | 2.803 | 2.774 | −0.029 |
| Green Dmax | 2.281 | 2.077 | −0.204 |
| Blue Dmax | 2.276 | 2.142 | −0.134 |
| Red Speed | 143.2 | 140.6 | −2.6 |
| Green Speed | 161.2 | 160.5 | −0.7 |
| Blue Speed | 162.5 | 161.2 | −1.3 |

TABLE IV

| | Blank Control (No Antioxidant) | 1,4-cyclohexanedione (Invention) | Difference (Invention) |
|---|---|---|---|
| Red Dmin | 0.104 | 0.104 | 0 |
| Green Dmin | 0.093 | 0.087 | −0.006 |
| Blue Dmin | 0.086 | 0.090 | 0.004 |
| Red Toe | 0.378 | 0.374 | −0.004 |
| Green Toe | 0.393 | 0.392 | −0.001 |
| Blue Toe | 0.357 | 0.363 | 0.006 |
| Red Shoulder | 2.151 | 2.088 | −0.063 |
| Green Shoulder | 1.834 | 1.800 | −0.034 |
| Blue Shoulder | 1.931 | 1.848 | −0.083 |
| Red Dmax | 2.844 | 2.780 | −0.064 |
| Green Dmax | 2.279 | 2.231 | −0.048 |
| Blue Dmax | 2.301 | 2.227 | −0.074 |
| Red Speed | 146.6 | 144.2 | −2.4 |
| Green Speed | 162.9 | 162.2 | −0.7 |
| Blue Speed | 165.4 | 163.2 | −2.2 |

TABLE V

| | Blank Control (No Antioxidant) | (2,5-dioxocyclohexyl)-acetic acid (invention) | Difference (invention) |
|---|---|---|---|
| Red Dmin | 0.103 | 0.104 | 0.001 |
| Green Dmin | 0.087 | 0.081 | −0.006 |
| Blue Dmin | 0.091 | 0.082 | −0.009 |
| Red Toe | 0.368 | 0.372 | −0.004 |
| Green Toe | 0.380 | 0.383 | 0.003 |
| Blue Toe | 0.345 | 0.344 | −0.001 |
| Red Shoulder | 2.149 | 2.131 | −0.018 |
| Green Shoulder | 1.851 | 1.832 | −0.019 |
| Blue Shoulder | 1.882 | 1.847 | −0.035 |
| Red Dmax | 2.798 | 2.819 | 0.021 |
| Green Dmax | 2.276 | 2.245 | −0.031 |
| Blue Dmax | 2.268 | 2.244 | −0.024 |
| Red Speed | 143.2 | 143.5 | 0.3 |
| Green Speed | 161.0 | 161.1 | 0.1 |
| Blue Speed | 162.5 | 162.6 | 0.1 |

Significantly smaller (desirable, less than 3.2%) sensitometric effects were observed when 1,4-cyclohexanedione was used as antioxidant compared with N,N-diethylhydroxylamine (about 8%). This is particularly noticeable in the green and blue shoulder and Dmax values. These results represent a 3–4% improvement (over a 50% improvement relative to N,N-diethylhydroxylamine) in minimizing adverse sensitometric effects caused by an antioxidant in a color paper developing composition. When (2,5-dioxocyclohexyl)acetic acid was used as the antioxidant (containing a preferred solubilizing group), essentially no adverse sensitometric effects were observed.

EXAMPLE 3

A color negative film color developing composition was prepared according to TABLE VI and 8 g/l of 1,4-cyclohexanedione was added before processing. The three following commercial color negative films were given a neutral step wedge test object exposure and then processed: KODAK GOLD Color Negative Film 200 speed, FUJI SGP Color Negative Film 800 speed, and KONICA JX-400 Color Negative Film. The resulting mid-scale slopes (mid-scale slope "MSS" is defined as the linear regression of image density over step 8 through 12 of the step wedge exposure) are summarized in TABLE VII in comparison with a process in which the color developing composition contained no 1,4-cyclohexanedione. All of the films were processed satisfactorily and there were no significant undesirable changes in film performance when 1,4-cyclohexanedione was present in the color developing composition.

TABLE VI

| Chemical | Amount per liter |
|---|---|
| Potassium carbonate | 37.5 g |
| Sodium sulfite | 3.75 g |
| Sodium bromide | 1.31 g |
| Potassium iodide | 1.2 mg |
| Diethylenetriaminepentaacetic acid, pentasodium salt (40% w/w solution) | 8.43 g |
| 4-(N-ethyl-N-(2-hydroxyethyl)amino)-2-methylaniline sulfate color developing agent | 4.52 g |
| pH | adjusted to 10.05 |

TABLE VII

| | No 1,4-cyclohexanedione (Blank) | | | 1,4-cyclohexanedione (8 g/l) (Invention) | | |
|---|---|---|---|---|---|---|
| Film | Red | Green | Blue | Red | Green | Blue |
| KODAK GOLD Color Film 200 | 0.475 | 0.463 | 0.424 | 0.477 | 0.462 | 0.430 |
| FUJI SGP 800 | 0.525 | 0.498 | 0.696 | 0.523 | 0.473 | 0.668 |
| KONICA JX-400 | 0.596 | 0.507 | 0.731 | 0.613 | 0.528 | 0.752 |

The invention has been described in detail with particular reference to preferred embodiments thereof, but it will be understood that variations and modifications can be effected within the spirit and scope of the invention.

We claim:

1. A photographic developing composition comprising:

a) a photographic developing agent, and b) at least 0.001 mol/l of a 1,4-cyclohexanedione antioxidant, said antioxidant being represented by the structure I:

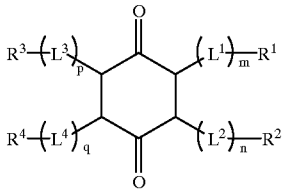

wherein m, n, p and q are independently 0 or 1, $L_1$, $L_2$, $L_3$ and $L_4$ are independently a divalent linking group, and $R_1$, $R_2$, $R_3$ and $R_4$ are independently hydrogen, alkyl, aryl, sulfo, carboxy, phospho, phosphono, phosphino, amino, cyano, hydroxy, cycloalkyl or a heterocyclic ring.

2. The developing composition of claim 1 wherein at least one of m, n, p and q is 1.

3. The developing composition of claim 1 wherein $L_1$, $L_2$, $L_3$ and $L_4$ independently comprise an alkylene group, a cycloalkylene group, an arylene group, oxy, thio, imino, carbonyl, sulfonyl or a combination of two or more such groups.

4. The developing composition of claim 3 wherein $L_1$, $L_2$, $L_3$ and $L_4$ independently comprise an alkylene group having 1 to 3 carbon atoms, phenylene, oxy or oxyalkylene having 1 to 3 carbon atoms.

5. The developing composition of claim 4 wherein $L_1$, $L_2$, $L_3$ and $L_4$ independently comprise methylene, oxy, phenylene or oxymethylene.

6. The developing composition of claim 1 wherein $R_1$, $R_2$, $R_3$ and $R_4$ are independently hydrogen, an alkyl group, an aryl group, a cycloalkyl group, a heterocyclic group, cyano, carboxy, sulfo, phosphono, phospho, phosphino, hydroxamic acid, hydroxy, or a corresponding salt where appropriate.

7. The developing composition of claim 6 wherein at least one of $R_1$, $R_2$, $R_3$ and $R_4$ is or comprises a solubilizing group that becomes negatively charged when ionized.

8. The developing composition of claim 7 wherein at least one of $R_1$, $R_2$, $R_3$ and $R_4$ is or comprises a sulfo, carboxy, phosphono or phospho group.

9. The developing composition of claim 1 wherein each of m, n, p and q is 0, and $R_1$ and $R_2$ together, or $R_3$ and $R_4$ together, are joined with sufficient numbers of carbon, oxygen, sulfur or nitrogen atoms to form a 5- or 6-membered unsaturated ring structure that is fused with the cyclohexane central ring.

10. The developing composition of claim 1 wherein said 1,4-cyclohexanedione is selected from the compounds:

I

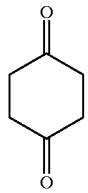

II

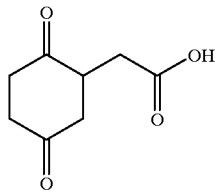

III

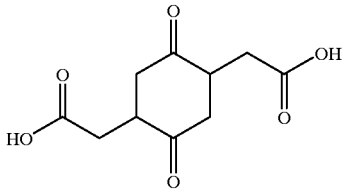

IV

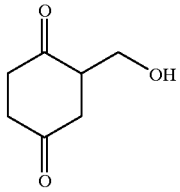

V

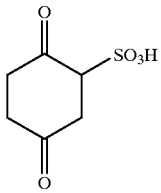

-continued

VI

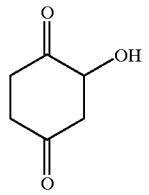

VII

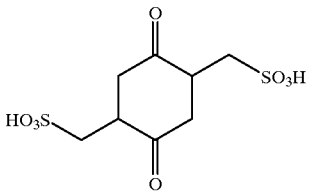

VIII

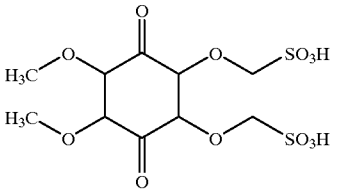

IX

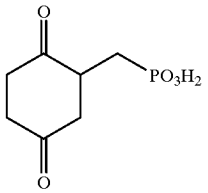

X

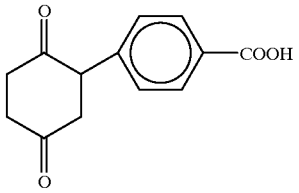

XI

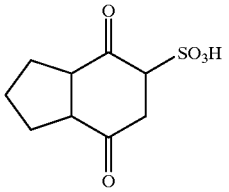

XII

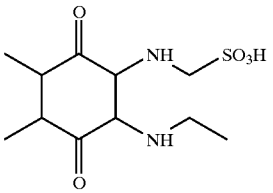

-continued

XIII

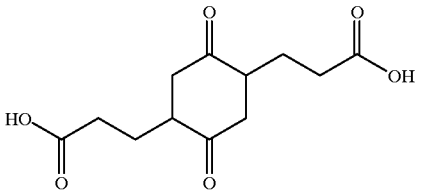

11. The developing composition of claim 10 wherein said 1,4-cyclohexanedione is

III

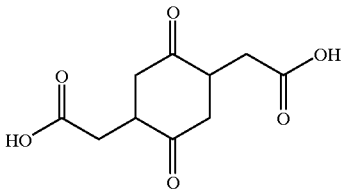

XIII

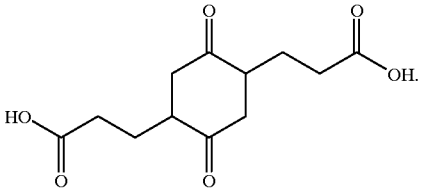

12. The developing composition of claim 1 wherein said developing agent is a color developing agent.

13. The developing composition of claim 1 which is formulated as an aqueous solution having a pH of from about 9 to about 12.

14. The developing composition of claim 1 which is formulated as a dry composition.

15. The developing composition of claim 1 wherein said developing agent is present in an amount of from about 0.005 to about 0.1 mol/l, and said 1,4-cyclohexanedione is present in an amount of from about 0.01 to about 0.1 mol/l, when both compounds are present in an aqueous solution.

16. The developing composition of claim 1 which is formulated as a concentrated single part, ready to use developing composition.

17. A photographic processing chemical kit comprising:

a) the photographic developing composition of claim 1, and b) one or more of the following compositions:

a photographic bleaching composition, a photographic bleach/fixing composition, a photographic fixing composition, and a photographic stabilizing or rinsing composition.

18. A method for providing an image in a photographic silver halide element contacting a photographic silver halide material with the developing composition of claim 1.

19. A method of photographic processing comprising the steps of:

A) developing an imagewise exposed photographic silver halide element with the photographic developing composition of claim 1, and B) desilvering said developed photographic silver halide element.

* * * * *

UNITED STATES PATENT AND TRADEMARK OFFICE

CERTIFICATE OF CORRECTION

PATENT NO. : 6,077,653
DATED : June 20, 2000
INVENTOR(S) : Tiecheng A. Qiao, Lynda W. McGarry It is certified that error appears in the above-identified patent and that said Letters Patent is hereby corrected as shown below:

Title page, column 1,

[75] Inventors: Tiecheng A. Qiao, Webster;
Lynda W. McGarry, North Chili, both of N.Y.

Signed and Sealed this

Eighteenth Day of September, 2001

*Attest:*

Nicholas P. Godici

NICHOLAS P. GODICI
*Acting Director of the United States Patent and Trademark Office*

*Attesting Officer*